US010689916B2

(12) United States Patent
Varkey et al.

(10) Patent No.: US 10,689,916 B2
(45) Date of Patent: Jun. 23, 2020

(54) METHODS AND SYSTEMS FOR DEPLOYING CABLE INTO A WELL

(71) Applicant: Schlumberger Technology Corporation, Sugar Land, TX (US)

(72) Inventors: Joseph Varkey, Sugar Land, TX (US); Vadim Protasov, Houston, TX (US); Harold S. Bissonnette, Heber Springs, AR (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/787,324

(22) PCT Filed: Apr. 30, 2014

(86) PCT No.: PCT/US2014/036139

§ 371 (c)(1),
(2) Date: Oct. 27, 2015

(87) PCT Pub. No.: WO2014/179447

PCT Pub. Date: Nov. 6, 2014

(65) Prior Publication Data

US 2016/0060967 A1 Mar. 3, 2016

Related U.S. Application Data

(60) Provisional application No. 61/817,789, filed on Apr. 30, 2013.

(51) Int. Cl.
*E21B 17/02* (2006.01)

(52) U.S. Cl.
CPC ..... *E21B 17/023* (2013.01); *E21B 17/026* (2013.01); *E21B 17/028* (2013.01)

(58) Field of Classification Search
CPC ..... E21B 17/023; E21B 17/026; E21B 17/028
(Continued)

(56) References Cited

U.S. PATENT DOCUMENTS 4,874,327 A 10/1989 Ip
5,577,560 A 11/1996 Coronado et al.
(Continued)

FOREIGN PATENT DOCUMENTS

EP 0198672 A2 * 10/1986 ..... E21B 17/023
EP 0511735 A2 11/1992
WO 2014179447 A1 11/2014

OTHER PUBLICATIONS

International Search Report for International Application No. PCT/US2014/036139 dated Sep. 30, 2014.
(Continued)

*Primary Examiner* — Anna M Momper
*Assistant Examiner* — Patrick F Lambe
(74) *Attorney, Agent, or Firm* — Eileen Pape

(57) ABSTRACT

An apparatus or system comprising, or a method utilizing, a pressure-tight head assembly coupling a multi-conductor wireline cable operable for downhole operations within a borehole extending into a subterranean formation. The head assembly comprises: an upper head attachment; a lower head attachment; an upper compression seal assembly; a gripper cone; and a rope socket. The upper compression seal assembly is threaded into and/or otherwise coupled to the upper head attachment in a manner causing the gripper cone to tighten onto the cable jacket.

10 Claims, 7 Drawing Sheets

(58) Field of Classification Search
USPC ..... 166/378
See application file for complete search history.

(56) References Cited

U.S. PATENT DOCUMENTS

| | | | | |
|---|---|---|---|---|
| 6,431,269 | B1 * | 8/2002 | Post | E21B 17/023 166/242.7 |
| 2003/0228783 | A1 * | 12/2003 | Cairns | G02B 6/4428 439/204 |
| 2004/0134667 | A1 | 7/2004 | Brewer et al. | |
| 2013/0183003 | A1 | 7/2013 | Cairns | |
| 2014/0029898 | A1 | 1/2014 | Snyder et al. | |
| 2014/0030903 | A1 | 1/2014 | Magno et al. | |
| 2015/0325997 | A1 | 11/2015 | Burrow et al. | |
| 2016/0060967 | A1 | 3/2016 | Varkey et al. | |
| 2017/0149231 | A1 | 5/2017 | Zivi et al. | |
| 2017/0186512 | A1 | 6/2017 | McFarland et al. | |
| 2017/0187177 | A1 | 6/2017 | Mangum | |
| 2017/0204679 | A1 | 7/2017 | Kartha et al. | |
| 2018/0010400 | A1 | 1/2018 | Thomas et al. | |
| 2018/0038169 | A1 | 2/2018 | Nicholson | |

OTHER PUBLICATIONS

International Preliminary report on patentability issued in the related PCT Application PCT/US2014/036139 dated Nov. 3, 2015 (9 pages).
Examination report issued in the related GB Application 1516014.6 dated Jul. 13, 2017 (3 pages).
Examination report issued in the related GB Application 1516014.6 dated Sep. 19, 2017 (4 pages).
Intention to Grant issued in the related GB Application 1516014.6 dated Oct. 7, 2017 (2 pages).
International Search Report and Written Opinion issued in the related PCT Application PCT/US2018/054496 dated Feb. 1, 2019 (13 pages).
Office Action received in the related U.S. Appl. No. 15/725,603 dated May 14, 2019 (26 pages).
Office Action issued in the corresponding BR application 112015026719.0, dated Apr. 6, 2020 (8 pages).

* cited by examiner

METHODS AND SYSTEMS FOR DEPLOYING CABLE INTO A WELL

CROSS-REFERENCE TO RELATED APPLICATIONS

This application claims priority to U.S. Patent Application 61/817,789, filed Apr. 30, 2013 and entitled "Sealing Wireline Cable Termination", which is incorporated herein in its entirety.

BACKGROUND

Existing wireline cables are often terminated in a rope socket inside the tool head of the downhole tool assembly. The layers of strength members in the rope socket may be wedged into place via a series of concentric cones. The cable core passes through the center of the rope socket, and the conductor wires are separated out and connected to conductor wires inside the downhole tool. Insufficient sealing may allow pressurized well fluids and gases to come into contact with the ends of the armor wires and the wiring connections. Such pressurized fluids may travel up the cable along conductors and strength members, perhaps causing damage as described above.

DETAILED DESCRIPTION OF THE INVENTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
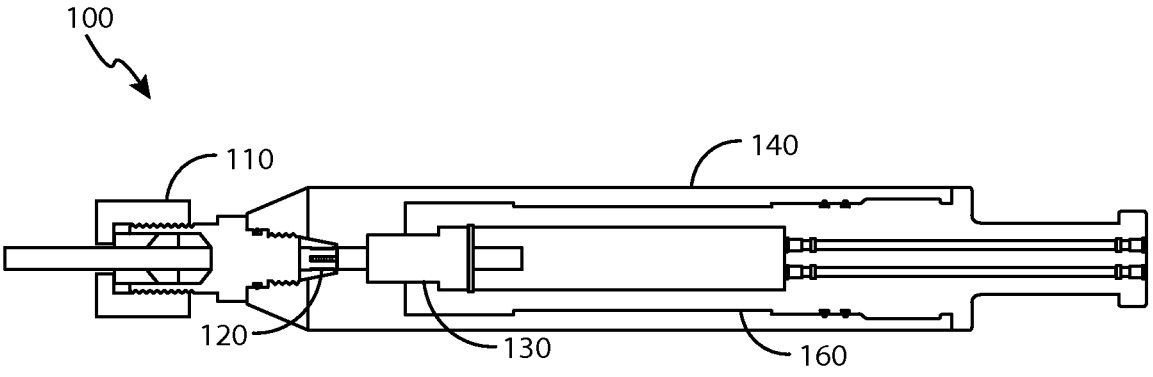
FIG. 1 depicts an example head assembly.

FIG. 1 depicts an example head assembly. The head assembly 100 includes and upper head attachment 140. A lower head attachment 160 is located within the upper head attachment 140. A rope socket 130 is located in the lower head attachment 130. A gripper cone is connected with the upper head attachment 140, and an upper compression seal assembly 110 is connected with the gripper cone 120.

Figure 2:
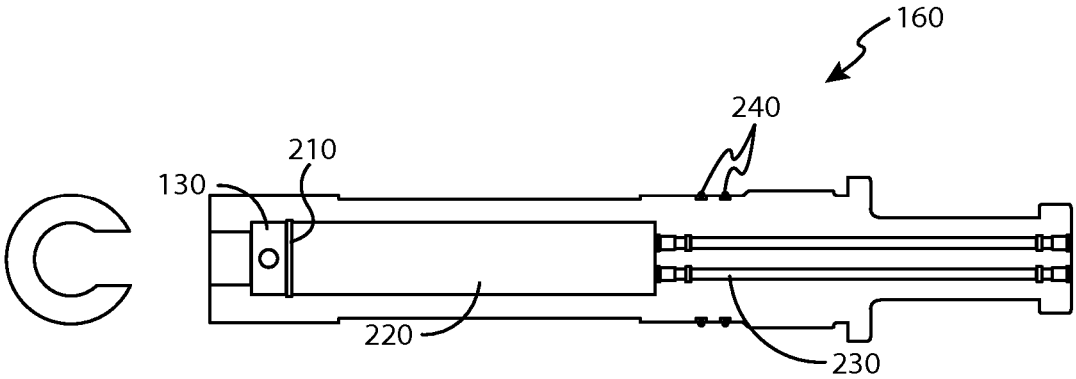
FIG. 2 depicts an example lower head attachment.
Figure 3:
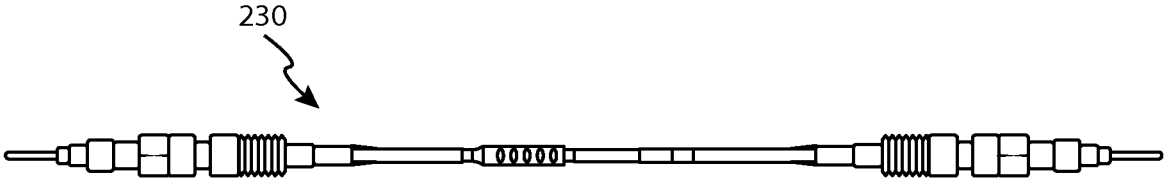
FIG. 3 depicts an example feed-through tube assembly.

FIG. 2 depicts an example lower head attachment. FIG. 3 depicts an example feed-through tube assembly. Referring to FIGS. 2 and 3, the lower head attachment 160 has seals 240 located thereabout. The lower head attachment 140 also has feed-through tubes 230 located therein. The feed-through tubes 230 can be operatively aligned with a breakout chamber 220. A slot 210 for operatively receiving a retaining feature, such as a clip, is formed in the lower head attachment 160, and a rope socket is adjacent the slot 210.

Figure 4:
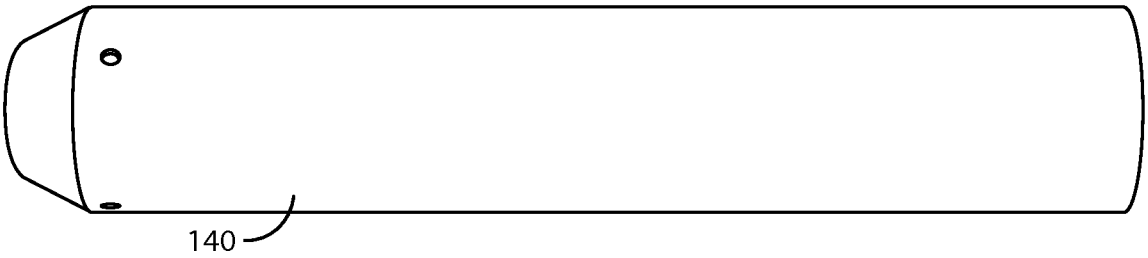
FIG. 4 depicts an example of an upper head attachment.

FIG. 4 depicts an example of an upper head attachment. The upper head attachment 140 is configured to receive at least a portion of the lower head attachment. The upper head attachment can be threaded, fastened, or otherwise connected with the lower head attachment.

Figure 5A:
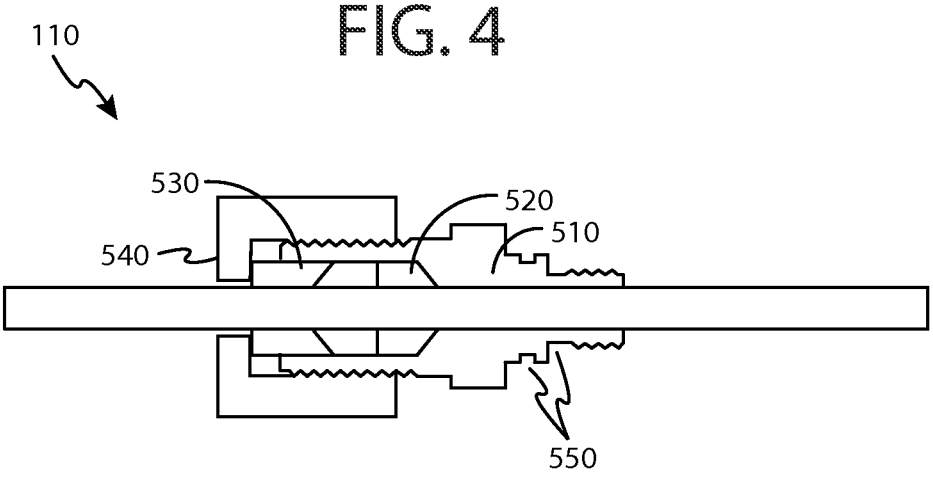
FIG. 5A depicts an example upper compression seal assembly.
Figure 5B:
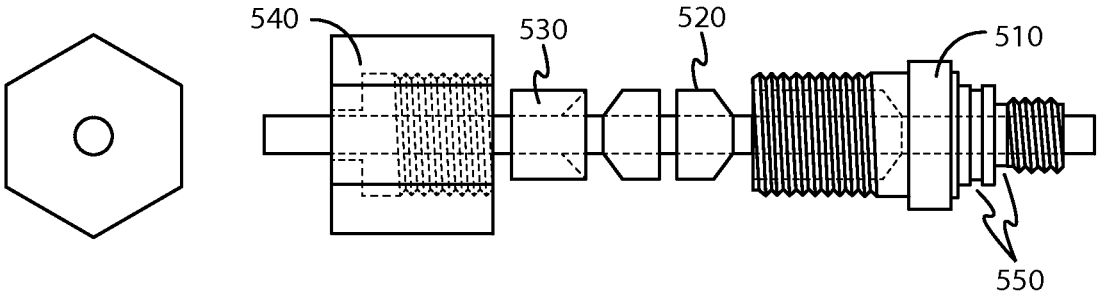
FIG. 5B depicts the example upper compression seal assembly in a pre-assembled configuration.

FIG. 5A depicts an example upper compression seal assembly. FIG. 5B depicts the example upper compression seal assembly in a pre-assembled configuration. The upper compression seal assembly 110 includes a first member 510. The first member 510 can be connected with the upper head attachment. One or more O-rings, gaskets, and/or other sealing members can be located at position 550. The first member 510 can thread or otherwise be fastened to the upper head attachment. The first member 510 can have an internal shape configured to receive compression members 520. The second member 530 can also have an internal shape to receive the compression members 520.

The compression nut 540 can be connected with the first member 510. The compression nut 540 can compress the compression members 520 as it is tightened onto the first member 510.

Figure 6:
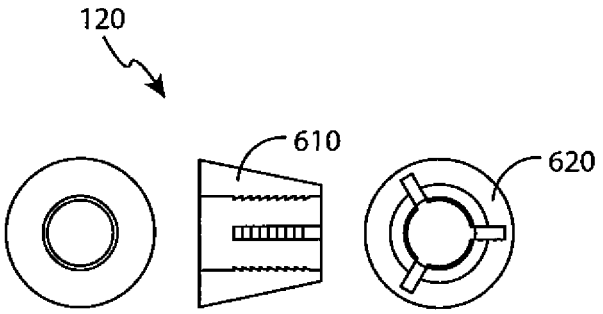
FIG. 6 depicts an example gripper cone.

FIG. 6 depicts an example gripper cone. The gripper cone 610 can have a base and a tapered end 620. The tapered end 620 can have slit to allow the gripper cone to close onto a cable as the gripper cone is tightened into place. The gripper cone has small angled teeth to hold a cable in place.

Figure 7:
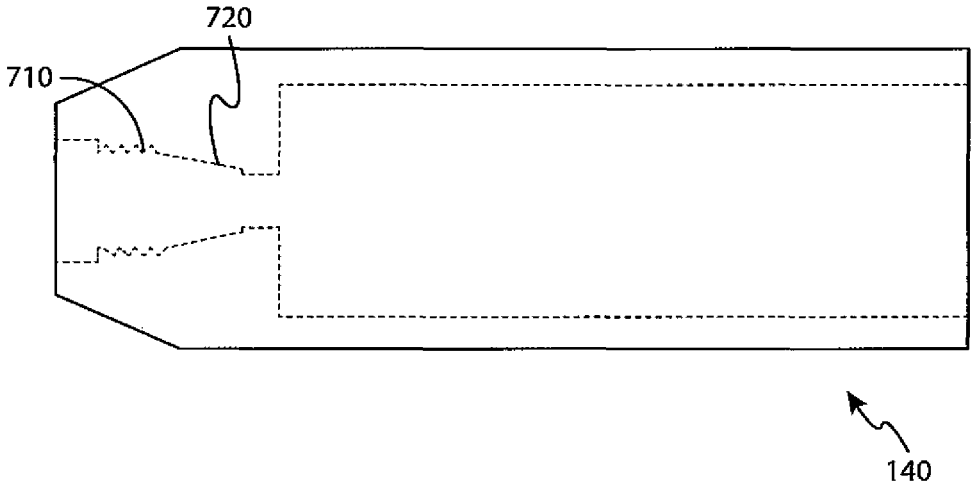
FIG. 7 depicts an example upper head attachment.

FIG. 7 depicts an example upper head attachment. The upper head attachment 140 can have an area 720 to attach with the gripper cone and area 710 to attach with the upper compression seal assembly.

Figure 8:
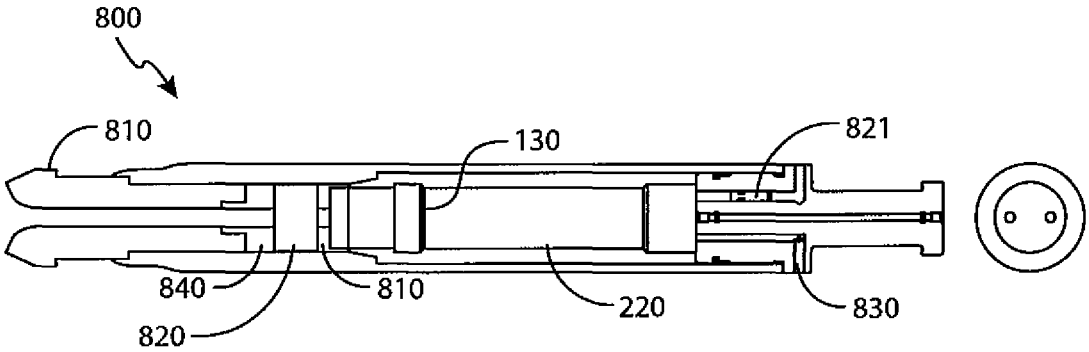
FIG. 8 depicts an example head assembly.
Figure 9:
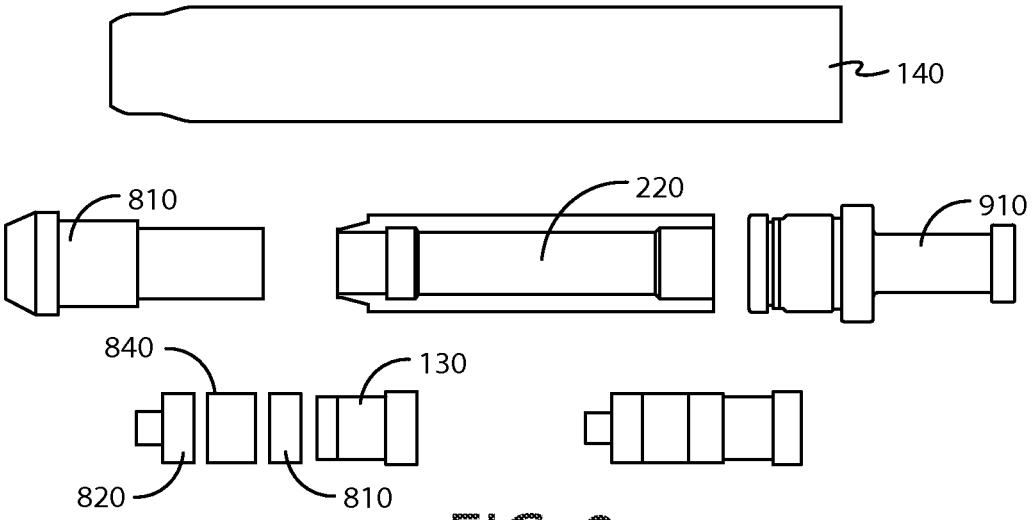
FIG. 9 depicts an exploded view of the head assembly of FIG. 8.

FIG. 8 depicts an example head assembly. FIG. 9 depicts an exploded view of the head assembly of FIG. 8. Referring to FIGS. 8 and 9, the head assembly 800 includes a fishing neck 810, an upper packoff bushing 840, a compression tool 810, a lower packoff bushing 810, the rope socket 130, the breakout chamber 220, a piston 821, and a fill port 830. The breakout chamber 220 can be filled with filler material. The filler material can be oil, liquid, grease, or fluid. The filler material can be supplied to the breakout chamber using the fill port 830.

The filler material may expand when in the presence of elevated downhole temperatures. The resulting pressure of the expanding filler material trapped inside the breakout chamber 220 may damage the conductors and/or other components of a cable. The piston 821 can be used to compensate for the expanding pressure.

For example, the cable may be terminated to the rope socket 130 and wiring may be completed in the breakout chamber. The compression tool 820 located between upper and lower packoff bushings 840 and 810 at the uphole end of the rope socket 130 may provide a high-pressure seal at the uphole end of the breakout chamber 220. After the head assembly is assembled, the breakout chamber 220 is filled with the filler material (e.g., oil, grease, and/or any other materials) via the fill port 830. The fill port may then be sealed with a plug and/or other means.

As the head assembly 800 is exposed to elevated downhole pressures, the expanding filler material in the breakout chamber 220 may push, force, and/or otherwise urge the piston 821 away from the breakout chamber 220. Such movement of the piston 821 may thus relieve the pressure building within the breakout chamber. As the temperature subsequently decreases, the borehole pressure may similarly urge the piston back toward the breakout chamber. The piston may, thus, also aid in preventing cross-contamination of borehole fluids into the breakout chamber, which may otherwise damage the conductors and/or other components therein. The lower head attachment may also comprise stops operable to limit travel of the piston.

Figure 10:
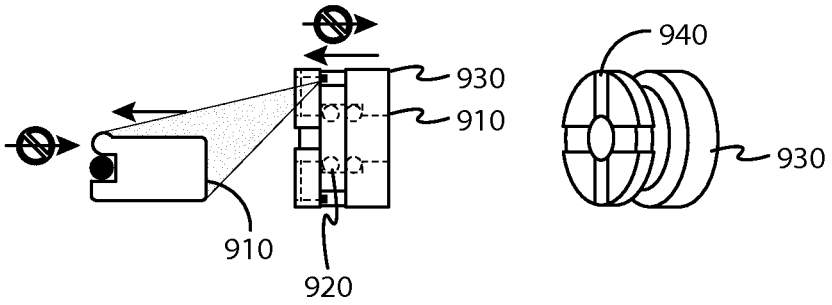
FIG. 10 depicts a pressure seal.

FIG. 10 depicts a pressure seal. The pressure seal 910 can be a one way seal that allows flow in one way but prevents flow in a second direction. The pressure seal 910 can be located in a housing 930. Seals in the housing 930 or around the seal 910 can prevent movement of the seal 910. The housing 930 can have channels 940 in an uphole face. The housing can have o-rings 920 located therein, which may prevent movement of fluid in either direction.

Figure 11:
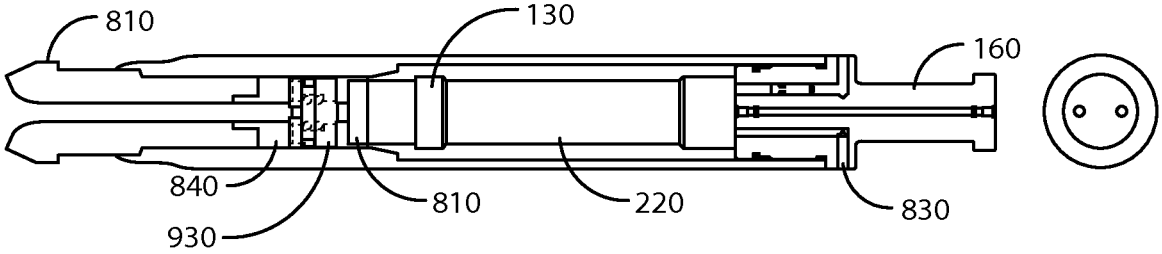
FIG. 11 depicts an example head assembly.
Figure 12:
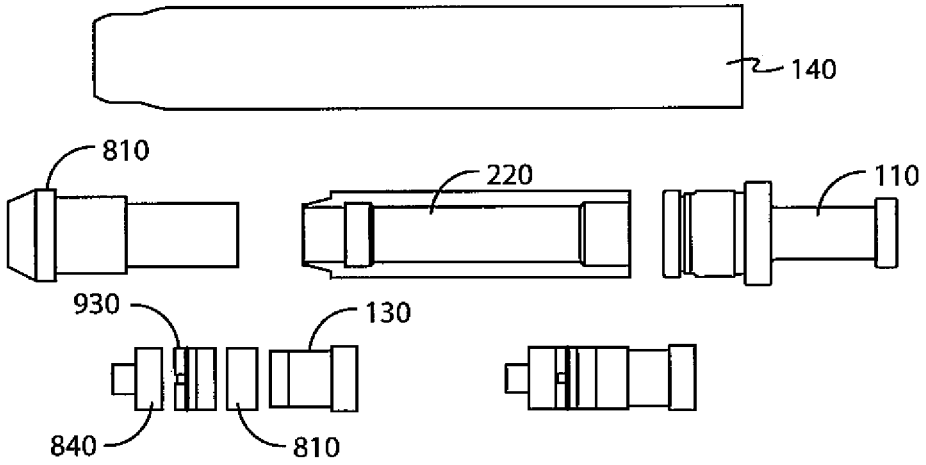
FIG. 12 depicts an exploded view of the head assembly of FIG. 11.

FIG. 11 depicts an example head assembly. FIG. 12 depicts an exploded view of the head assembly of FIG. 11. The head assembly includes the fishing neck 810, the upper packoff bushing 840, the housing 930 with the pressure seal 930, a lower packoff bushing 810, the rope socket 130, the breakout chamber 220, a fill port 830, and the lower head attachment 160.

The channels in the housing 930 can provide a flow path for fluid exiting the breakout chamber and the seal can allow fluid to flow out of the breakout chamber. The seal can prevent other fluid from entering the breakout chamber.

Figure 13:
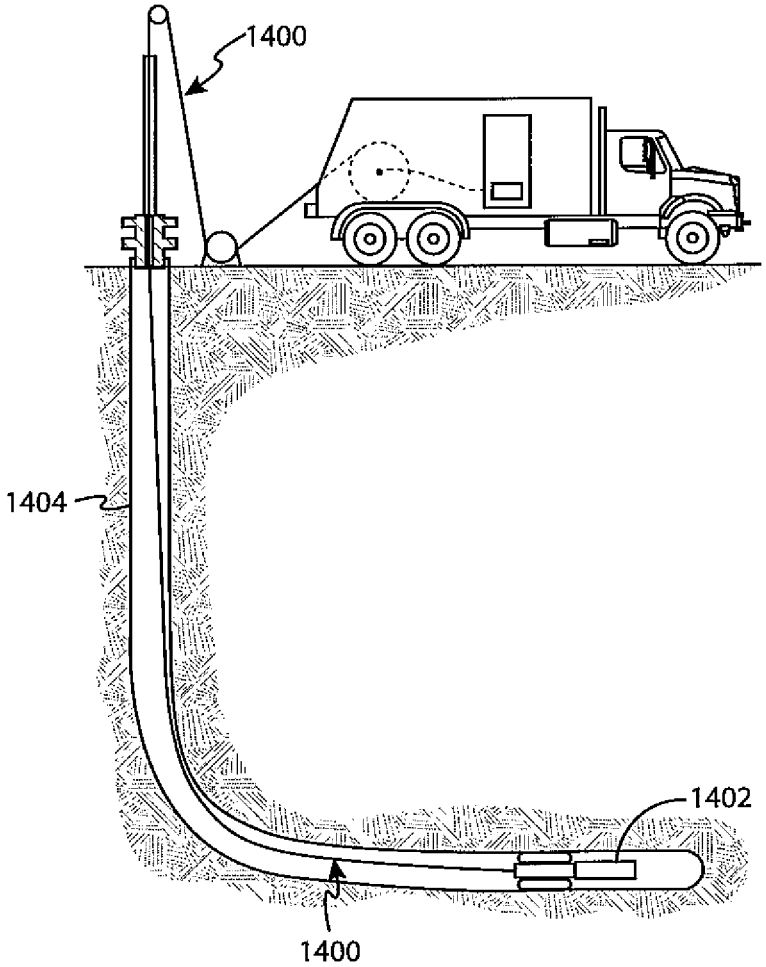
FIG. 13 depicts an example implementation utilizing a cable with a sealing termination during tractoring.

Referring now to FIG. 13, a cable having a sealing termination according to one or more aspects of the present disclosure is indicated generally at 1400. FIG. 13 depicts an example implementation utilizing a cable with a sealing termination during tractoring, in which a tractor 1402 is attached to the end of the cable 1400 when deployed in a wellbore or borehole 1404, which may have one or more vertical, horizontal, deviated, dog-legged, and/or multi-lateral wellbore sections.

Figure 14:
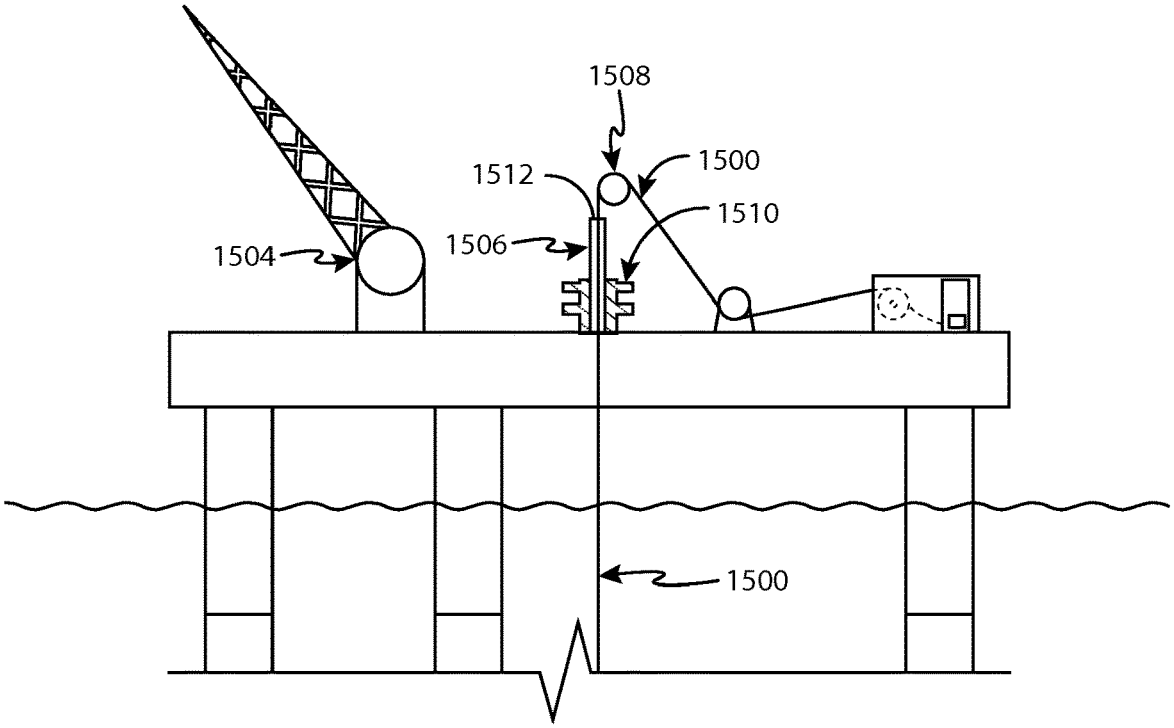
FIG. 14 depicts an example implementation utilizing a cable with a sealing termination.

Referring now to FIG. 14, a cable having a sealing termination according to one or more aspects of the present disclosure is indicated generally at 1500. Many offshore platforms utilize a means of supporting the wellhead equipment 1502 when performing a wireline operation without the use of the drilling derrick (not shown). A crane 1504 may be one manner of doing this. A mast unit or other temporary derrick (not shown) may also or alternatively be utilized. A standard wireline rig up offshore may utilize a crane 1504 or mobile mast unit (not shown) to support both the upper sheave wheel and the pressure equipment itself. A pack off assembly 1506 may utilize an upper sheave 1508 mounted to the well head equipment 1510 itself at the top of the lubricator 1512.

Figure 15:
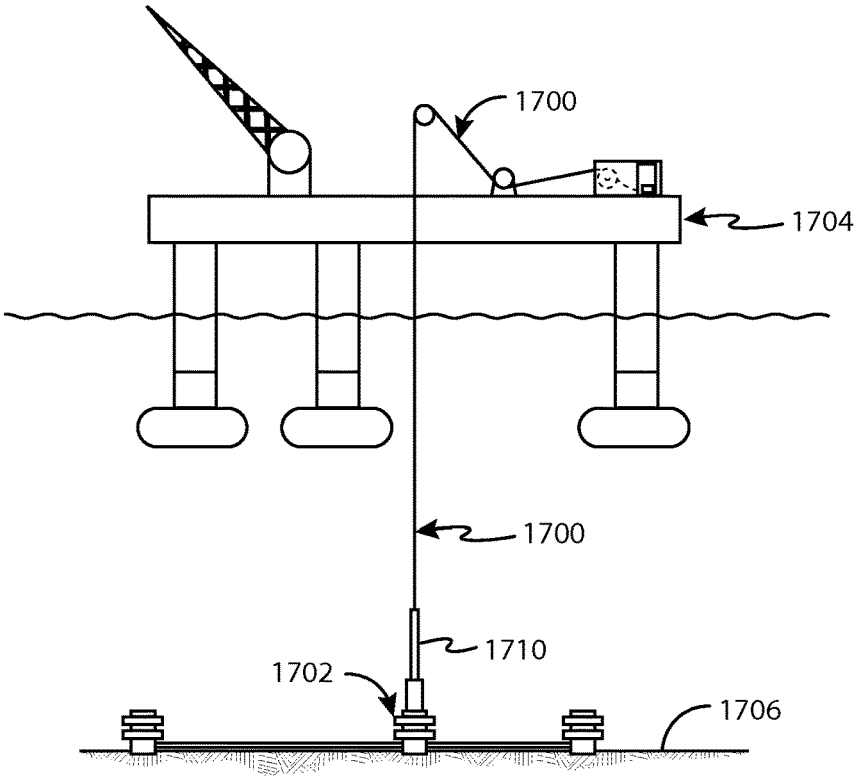
FIG. 15 depicts an implementation for subsea intervention.

Referring now to FIG. 15, a cable having a sealing termination according to one or more aspects of the present disclosure is indicated generally at 1700. FIG. 15 depicts an implementation for subsea intervention. A lubricator system may be lowered onto the subsea well head 1702, using grease injection into flow tubes to establish a dynamic pressure seal (stuffing box 1710), with the cable returning through open water back to surface on the intervention vessel (not shown) or the rig/platform 1704. For shallow water applications, the grease injection system, including the grease tank, can be installed on the vessel or rig/platform 1704, and pressurized grease can be conveyed to the grease head at the seabed 1706 through a control umbilical (not shown) or through a dedicated hose (not shown). For well intervention operations with a subsea lubricator in deep water, the injection system 1708 may be placed subsea.

Figure 16:
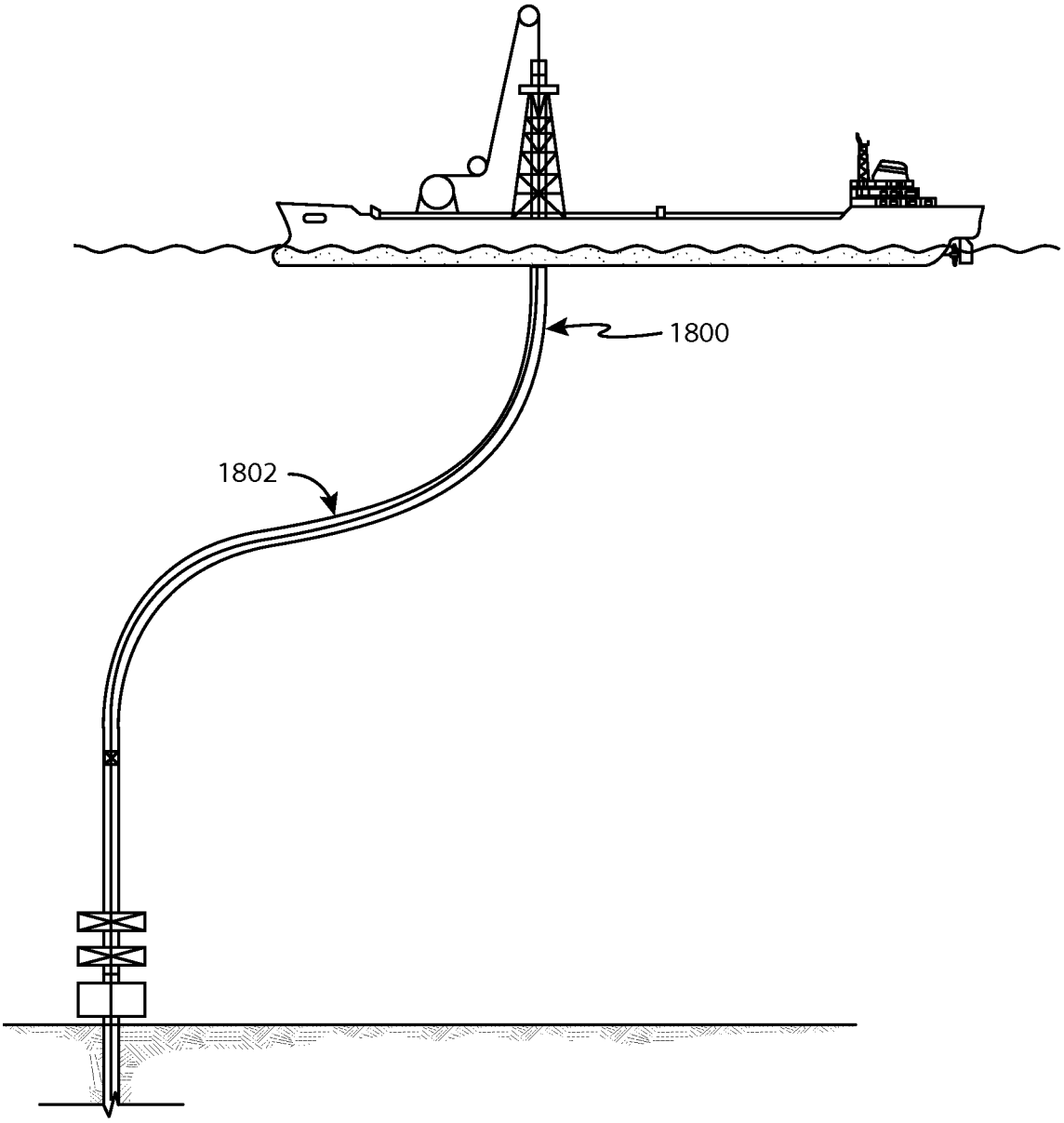
FIG. 16 depicts an example implementation utilizing a cable with a sealing termination.

Referring now to FIG. 16, a cable having a sealing termination according to one or more aspects of the present disclosure is indicated generally at 1800. The cable 1800 may be utilized in combination with a spoolable compliant guide system 1802. A pack-off type dynamic seal may be retrievable through the compliant guide 1802.

Other implementations within the scope of the present disclosure may logging with a cable having a sealed termination as described above while a fluid is injected in the well.

What is claimed is:

1. A head assembly for a cable, wherein the head assembly comprises:

an upper head attachment;

a lower head attachment disposed within the upper head attachment, wherein a breakout chamber is located in the lower head attachment and filled with a fluid, and wherein a rope socket is located in the breakout chamber, wherein the breakout chamber is in fluid communication with a flow path, and wherein the flow path comprises a piston, the piston disposed in the lower head attachment;

an upper compression seal assembly; and a gripper cone;

wherein the fluid in the breakout chamber urges the piston to an expanded position away from the breakout chamber in response to an increase in downhole pressure.

2. The head assembly of claim 1, wherein the upper compression seal assembly is configured to connect with the upper head attachment and cause the gripper cone to tighten onto the cable.

3. The head assembly of claim 1, wherein the lower head attachment is connected with the upper head attachment.

4. The head assembly of claim 1, wherein the lower head attachment has a retaining feature for securing the rope socket therein.

5. The head assembly of claim 1, further comprising a feed-through tube assembly operatively aligned with the breakout chamber.

6. The head assembly of claim 1, wherein the upper compression seal assembly comprises a pair of polymeric compression seal members.

7. A downhole system comprising:

a head assembly for a cable, wherein the head assembly comprises:

an upper head attachment;

a lower head attachment disposed within the upper head attachment, wherein a breakout chamber is located in the lower head attachment and filled with a fluid, wherein the breakout chamber is in fluid communication with a flow path, and wherein the flow path comprises a piston, the piston disposed in the lower head attachment;

an upper compression seal assembly;

a gripper cone; and a rope socket located in the breakout chamber;

a cable connected with the rope socket; and a downhole tool connected with the head assembly, wherein the cable is in electrical communication with the downhole tool;

wherein the fluid in the breakout chamber urges the piston to an expanded position away from the breakout chamber in response to an increase in downhole pressure.

8. The system of claim 7, further comprising a feed-through tube assembly operatively aligned with the breakout chamber.

9. The system of claim 8, wherein the cable is connected with the feed-through tube assembly in the breakout chamber.

10. A method of connecting a cable with a tool, comprising:

terminating the cable with a rope socket, wherein the rope socket is located in a lower head attachment that is connected and disposed within an upper head attachment;

connecting at least a portion of the cable to a connecting wire of the tool in a breakout chamber formed in the lower head attachment, wherein the rope socket is in the breakout chamber, and wherein the breakout chamber is in fluid communication with a flow path, and wherein the flow path comprises a piston, the piston disposed in the lower head attachment;

placing the cable through a gripper cone, wherein the gripper cone is adjacent the upper head attachment;

placing the cable through an upper compression seal assembly;

tightening the upper compression seal assembly to provide a pressure tight seal about the cable and tighten the gripper cone about the cable; and filling the breakout chamber with a fluid, wherein the fluid urges the piston to an expanded position away from the breakout chamber in response to an increase in downhole pressure.

* * * * *